United States Patent [19]

Baumgart

[11] Patent Number: 4,759,156

[45] Date of Patent: Jul. 26, 1988

[54] BLAST MEDIA TRANSPORT AND THROWING WHEEL

[75] Inventor: Jurgen Baumgart, Huntington Beach, Calif.

[73] Assignee: ACD, Inc., Santa Ana, Calif.

[21] Appl. No.: 897,848

[22] Filed: Aug. 19, 1986

[51] Int. Cl.[4] ..... B24C 5/06

[52] U.S. Cl. ..... 51/432; 51/434; 51/268

[58] Field of Search ..... 51/322, 268, 410, 431, 51/432, 433, 434, 435, 436; 241/275; 416/174

[56] References Cited

U.S. PATENT DOCUMENTS

| | | | |
|---|---|---|---|
| 2,204,587 | 6/1940 | Guendling | 51/432 |
| 2,224,153 | 12/1940 | Guendling | 51/432 |
| 4,329,819 | 5/1982 | May | 51/432 |
| 4,333,278 | 6/1982 | Schulte et al. | 51/434 |
| 4,651,477 | 3/1987 | Brucher | 51/432 X |

FOREIGN PATENT DOCUMENTS

| | | | |
|---|---|---|---|
| 594513 | 3/1960 | Canada | 51/432 |
| 559084 | 2/1975 | Switzerland | 51/435 |

*Primary Examiner*—Robert P. Olszewski

*Attorney, Agent, or Firm*—Jackson & Jones

[57] ABSTRACT

A blast media transport and throwing wheel apparatus includes a throwing wheel in the form of a straight vane centrifugal fan with a conically shaped axial opening therein for receiving the blast media (e.g. pellets) to be propelled against molded article to be deflashed. A shroud surrounds the throwing wheel and includes an entrance opening aligned with the axial opening and an exit opening through which the media is propelled. A feed cage is mounted on the shroud and extends into the axial opening and a feed tube connects the feed cage with a hopper containing a static quantity of the media. The feed cage includes a passageway for directing the media into the throwing wheel on one side of the rotational axis thereof.

5 Claims, 3 Drawing Sheets

BLAST MEDIA TRANSPORT AND THROWING WHEEL

BACKGROUND OF THE INVENTION

1. Field of the Invention

The present invention relates to cryogenic deflashing apparatus for removing flash and burrs from molded parts in a low temperature environment by the bombardment of the articles with a high velocity pellet or media stream and more particularly to a blast media transport and throwing wheel for use in such apparatus.

2. Description of the Prior Art

The molding of articles from plastic, rubber and other materials generally leaves a residual flash on the articles in the area adjacent the interfacing mold surfaces. Such flash is functionally and aesthetically objectionable. The removal of such flash by hand trimming is costly and sometimes difficult.

To eliminate the hand trimming operation deflashing apparatus has been developed which cools the flash through the use of liquid cryogens, e.g. $N_2$, to the embrittlement point and then subjects the articles to a high velocity stream of pellets, commonly referred to as the blast or deflashing media.

Throwing wheels used for propelling the blast media against the articles to be deflashed are typically centrifugal devices similar in configuration to straight vane centrifugal fans. The blast media to be accelerated is introduced at the eye (i.e. an axial opening) of the centrifugal impeller or wheel by a feed cage. The media is accelerated by the wheel's radially extending vanes and directed in a preselected pattern against the articles. The width of the pattern is controlled by the width of the vanes while the length and direction of the pattern are controlled by the opening in the feed cage and its location. The shroud which surrounds the wheel serves to contain and direct the stray pellets. Unlike the flow of air into the impeller of a centrifugal fan, the feed cage restricts the flow of the media or pellets to only a fraction of the total circumference of the axial opening. See for example, U.S. Pat. No. 3,368,308 and application Ser. No. 918,707 filed June 26, 1978 (abandoned). Although such prior art throwing wheels have proven useful in their general application there are substantial deficiencies associated with their use.

In particular the prior art throwing wheels while meeting the requirement of accelerating the media to the required exit velocity also pump large amounts of air with the media. The pumped air serves no purpose in the deflashing process but does raise the power required to drive the throwing wheel substantially. The increased power not only results in a larger motor and armature current for the throwing wheel than would otherwise be necessary but also results in heating the atmosphere surrounding the article being deflashed. This added heat load must be removed by additional cooling which adds to the overall cost of the deflashing process.

The prior art throwing wheels are typically positioned above the articles to be deflashed with the feed cage and a feed tube (for channeling the media to the feed cage) extending horizontally from the throwing wheel. The feed cage is arranged to feed the media into an area above the rotational axis of the wheel. A conveyor mechanism typically in the form of a screw conveyor has been used to move the media horizontally along the feed tube, force it into the feed cage and up into the throwing wheel. However, the use of such a screw conveyor requires an additional prime mover to rotate the conveyor with its attendant cost, power requirements and maintenance.

There exists a substantial need in the art for a blast media transport and throwing wheel which eliminate the above-mentioned deficiencies.

SUMMARY OF THE INVENTION

In accordance with the present invention a blast media and throwing wheel apparatus for propelling blast media in the form of pellets or the like against molded articles to remove residual flash therefrom is provided which includes a throwing wheel arranged to rotate about an axis. The throwing wheel has a pair of circular plates between which a plurality of radially extending vanes are sandwiched. One of the plates and the innermost edges of the vanes define an axial opening for receiving the media to be propelled. The axial opening is preferably conical in shape.

A shroud surrounds the throwing wheel and has an exit opening at one end through which the media ia directed against the articles. The shroud also has an entrance opening aligned with the opening in the circular plate of the throwing wheel.

A feed cage is mounted on the shroud and extends through the entrance opening therein and into the axial opening in the throwing wheel. The feed cage is provided with a passageway through which media is channeled with the passageway being preferably arranged to direct the media into the throwing wheel above the rotational axis.

A hopper for holding a static quantity of the media is positioned above the feed cage and a feed tube is connected between the hopper and the passageway in the feed cage. The feed tube is preferably of a sufficient length to substantially prevent air from entering the throwing wheel through the feed cage and provide a vacuum at the axial opening in the throwing wheel of about twenty to thirty inches of water during rotation of the wheel.

To prevent air outside of the feed cage from entering the axial opening in the throwing wheel a rotating seal is preferably positioned between the end plate of the wheel having the axial opening and the feed cage or shroud.

The features of the present invention which are novel and set forth with particularity in the appended claims. The invention, both as to its organization and operation, together with further objects and advantages thereof may best be understood by reference to the following description taken in conjunction with the accompanying drawings.

DESCRIPTION OF THE PREFERRED EMBODIMENT

Figure 1:
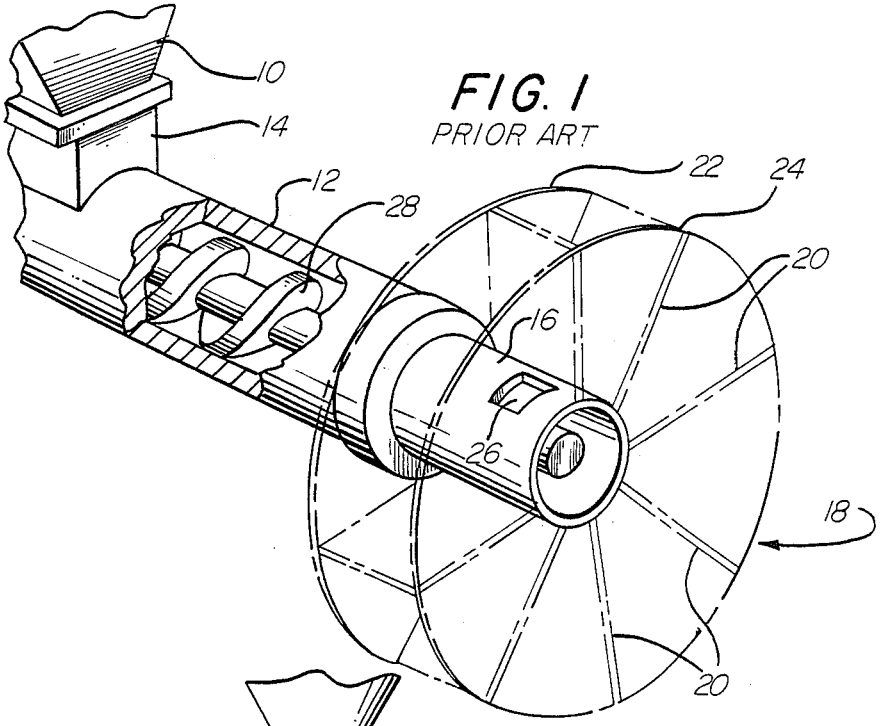
FIG. 1 PRIOR ART
FIG. 1 is a perspective view, partially broken away of a prior art blast media transport and throwing wheel assembly.
Figure 2:
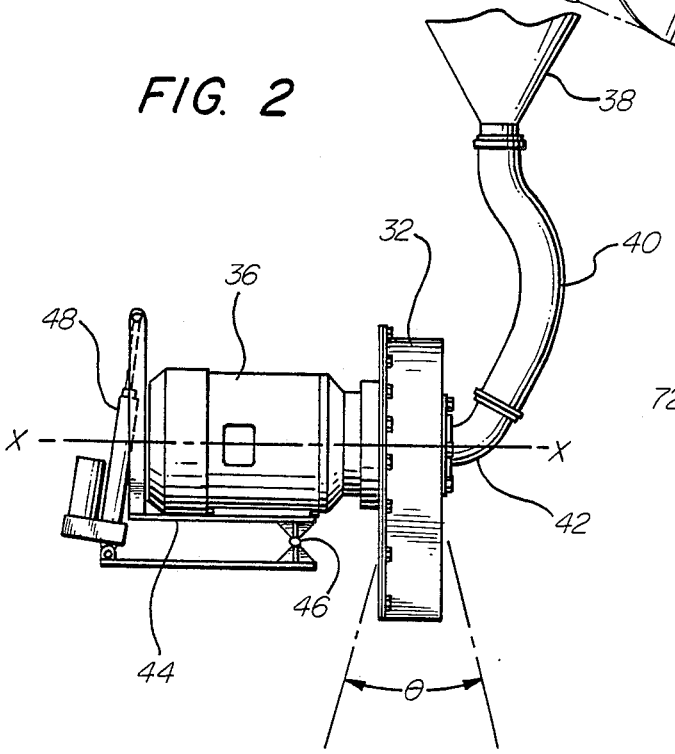
FIG. 2 is an elevational view of a blast media transport and throwing wheel apparatus in accordance with this invention.
Figure 3:
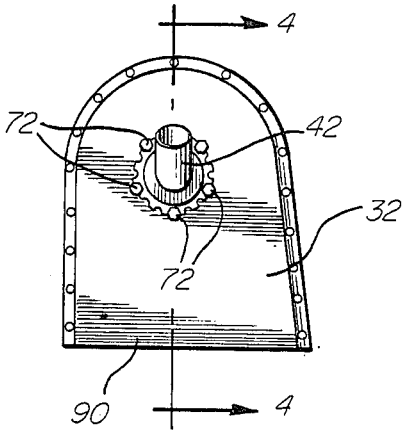
FIG. 3 is an end view of the apparatus of FIG. 2 without the feed tube and hopper assembly.

Referring now to the drawings and particularly to FIG. 1 there is illustrated a prior art media transport and throwing wheel apparatus for propelling media such as plastic pellets, steel shot or the like against molded articles to remove the residual flash therefrom in a cryogenic environment. The apparatus includes a hopper 10 (partially cut away) for holding a static quantity of the blast media. A feed tube 12 is connected to the hopper through a rectangular conduit 14 at one end and to a cylindrical feed cage 16 at the other end as shown. A throwing wheel 18 is mounted for rotation around the feed cage 16 and includes a plurality of radially extending vanes or blades 20 sandwiched between annular plates 22 and 24. The media (pellets) are fed into the eye or axial opening in the throwing wheel through a slot 26 located at the top of the feed cage 16 as illustrated. The media is transported along the feed tube 12 and into the feed cage to exit therefrom through the slot 26 via a screw conveyor 28 driven by a motor (not shown).

Referring now to FIGS. 2-5 there is illustrated a media transport and throwing wheel apparatus in accordance with my invention. A shroud 32 encloses a throwing wheel 34 (see FIG. 4) which is driven around a rotational axis x—x by an electric motor 36. A hopper 38 is provided for holding a static quantity of the blast media. A feed tube or media conduit 40 and a feed cage 42 connect the hopper 38 to the throwing wheel as will be explained. A platform 44 which supports the motor 36 is pivoted about a fulcrum 46 at one end and connected to an extensible arm 48 at the other end to permit the throwing wheel and shroud 32 to be selectively positioned within the angle $\theta$ to facilitate the removal of flash from different articles.

Figure 4:
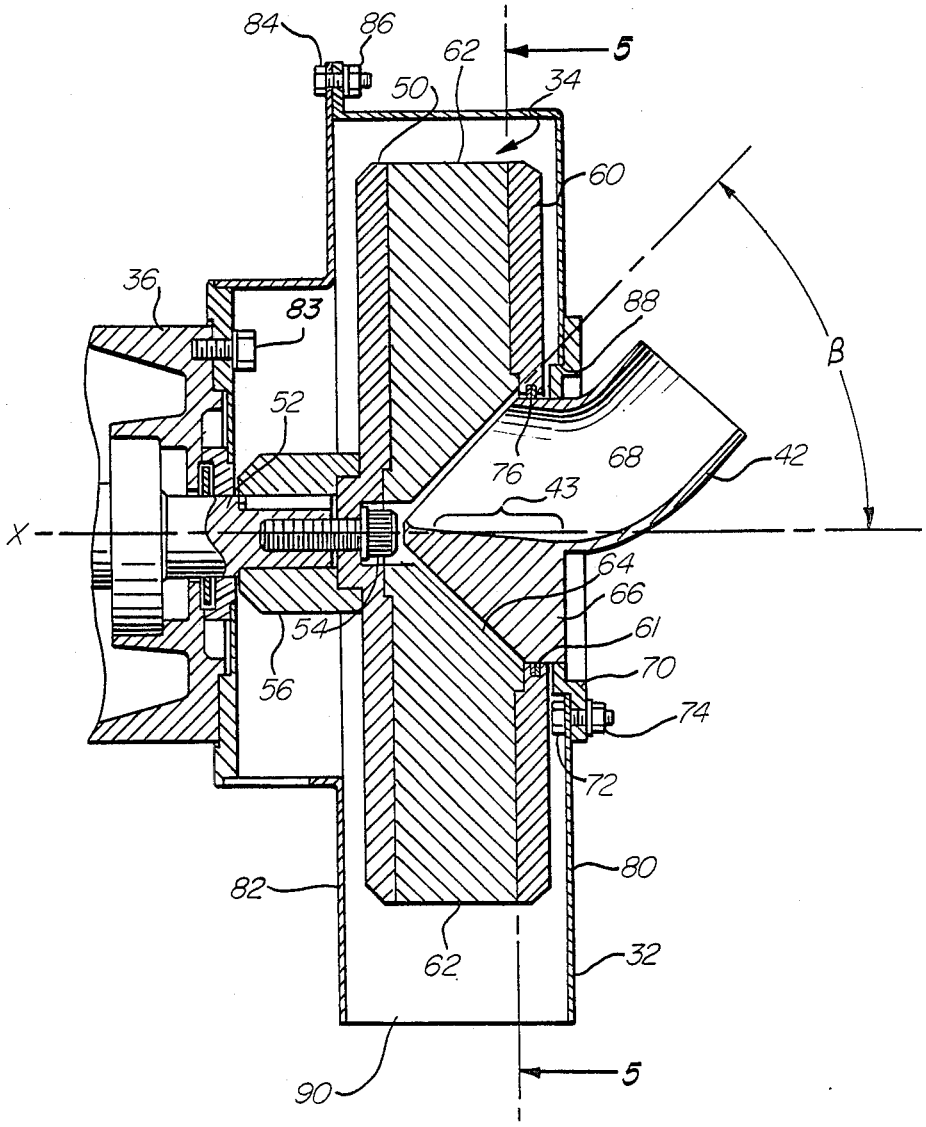
FIG. 4 is an enlarged cross sectional view of the apparatus of FIG. 3 taken along lines 4—4 of FIG. 3.
Figure 5:
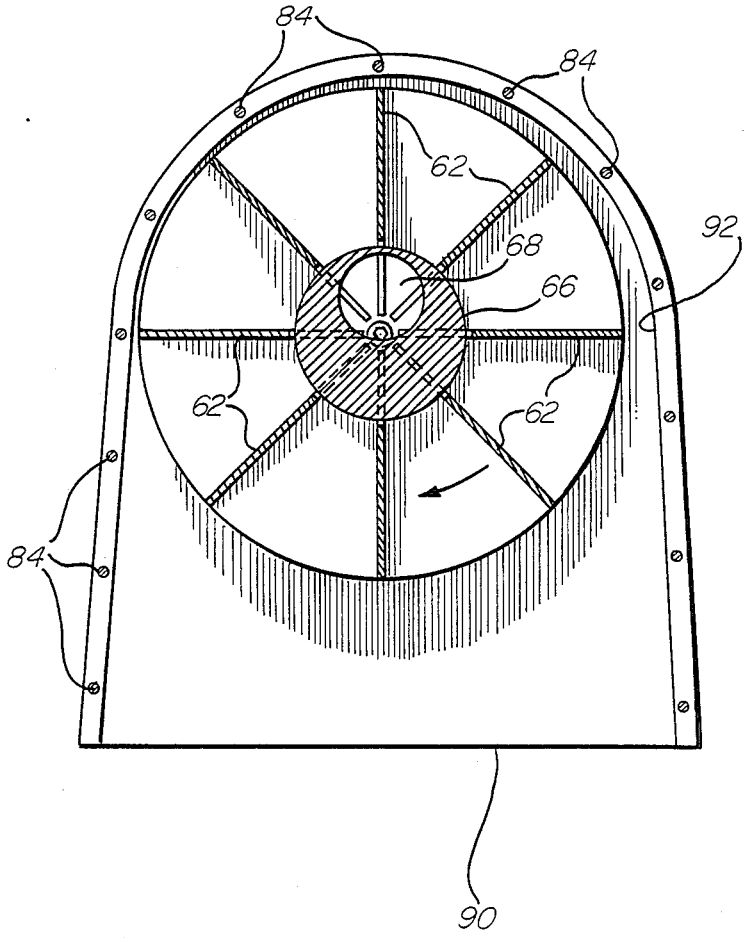
FIG. 5 is a cross sectional view of the apparatus of FIG. 4 taken along lines 5—5 in FIG. 4.

Referring now to FIGS. 4 and 5 the throwing wheel comprises a running head 50 in the form of a circular plate secured to a shaft 52 of the motor 36 by means of a bolt 54 and collar 56. An annular end plate 60 with a central opening 61 is spaced from and coaxially alligned with the running head 50. A plurality of radially extending vanes 62 are secured between the plates 50 and 60 by suitable means such as welding or bolts (not shown). FIGS. 2, 3, 4 and 5 depict an assembly made from fabricated parts. Obviously other manufacturing processes such as casting are possible.

As illustrated in FIG. 4 the innermost edges 64 of the vanes 62 extend from the opening 61 in the end plate 60 toward the axis x—x at an acute angle $\beta$. Preferable the angle $\beta$ is about 45°. The innermost edges 64 of the vanes 62 and inner edge 61 of the end plate 60 define a cone shaped axial opening in the throwing wheel of decreasing size as it extends toward the plate 50. The axial opening receives the media to be accelerated and propelled against the molded articles (not shown) by the throwing wheel.

The feed cage 42 includes a cone shaped portion 66 extending into the axial opening in the throwing wheel with an inner passageway 68 terminating adjacent the inner edges 64 of the vanes 62 above the rotational axis x—x. As shown the passageway 68 makes a bend of about 45° as it extends through the feed cage 42. The low pressure (or vacuum) created in the axial opening of the throwing wheel moves the media the short distance from the 45° bend along the horizontal portion 43 of the feed cage and into the wheel. Since the passageway 68 is positioned above the rotational axis of the throwing wheel no separate transport system such as the screw conveyor of FIG. 1 is needed. The feed cage includes a flange 70 which is secured to the shroud 32 by means of suitable fasteners such as nut and bolts 72, 74.

A sealing ring 76 is carried in the inner edge 61 of the end plate 60 for sealing against the a peripheral portion of the feed cage as is shown in FIG. 4. During rotation of the throwing wheel the ring 76 functions as a rotating seal to prevent ambient air or gas outside of the feed cage from entering the axial opening in the throwing wheel. In some applications cryogenic gas (i.e. $N_2$) may replace the air inside of the deflashing chamber.

As is illustrated in FIGS. 4 and 5 the shroud 32 comprises two members 80 and 82 fastened together by nuts and bolts 84 and 86. The inner member 82 is bolted to the housing of the motor 36 by bolts 83. The shroud 32 has an entrance opening 88 through which the feed cage is inserted and an exit opening 90 through which the media is directed against the molded articles.

Looking at the cross sectional view of FIG. 5 it may be seen that the shroud 32 is shaped in the form of a volute i.e. the distance of the inner wall 92 thereof increases in distance from the center of the throwing wheel in the direction of rotation (clockwise). This volute shape enhances the efficiency of the throwing wheel.

The feed tube 40 (FIG. 2) when full of media substantially blocks ambient air from entering the throwing wheel through the feed cage. To further increase the efficiency of the apparatus the feed tube 40 is provided with a sufficient length so that when the hopper and feed tube are filled with the media a pressure differential from the suction side (axial opening) to the discharge side 90 of the throwing wheel is maintained large, e.g. of the order of twenty to thirty inches of water. This high pressure differential reduces the density of the air entering the throwing wheel as well as greatly reducing the volume of air the wheel is capable or pumping so that the energy required of the throwing wheel is almost entirely used in accelerating the media and to a much smaller degree to pump air.

There has been described a novel media transport and throwing wheel apparatus for use in cryogenic deflashing apparatus. Variations of the present invention are possible in light of the above teachings. For example, the rotating seal 76 may be positioned between the end plate 60 of the throwing wheel and the shroud instead of between the end plate and the feed cage. Many other modifications will readily occur to those skilled in the art without involving any departure from the spirit and scope of the invention.

What is claimed is:

1. A blast media transport and throwing wheel apparatus for propelling blast media against molded articles to remove residual flash therefrom which comprises:

a throwing wheel arranged to rotate about an axis and including a pair of circular plates with a plurality of radially extending vanes secured between the plates, one of the plates and the innermost edges of the vanes defining an axial opening for receiving media to be propelled, the axial opening being generally conical in shape;

a shroud surrounding the throwing wheel, the shroud having an exit opening at one end through which the media is directed against the molded articles, and an entrance opening coaxially alligned with the opening in said one plate of the throwing wheel, the exit opening being positioned below the throwing wheel;

a feed cage mounted on the shroud and extending through the entrance opening therein and into the axial opening in the throwing wheel, the feed cage having passageway therethrough above the rotational axis for directing the media into the throwing wheel;

a hopper for holding a static quantity of the media;

media conduit means connected between the hopper and the feed cage for conducting media from the hopper to the passageway in the feed cage, the media conduit means being arranged to provide a barrier to gas flow when filled with media to thereby substantially prevent ambient gas or air from entering the feed cage from the media conduit means during rotation of the throwing wheel; and rotating seal means disposed between said one plate of the throwing wheel and one of the feed cage and shroud members to prevent air outside of the feed cage from entering said axial opening during rotation of the throwing wheel whereby the rotation of the throwing wheel provides a low pressure within the opening in the feed cage to aid in transporting media from the hopper to the throwing wheel.

2. The blast media transport and throwing wheel of claim 1, wherein the media conduit means has a cross-sectional flow area and length sufficient to produce a low pressure in the axial opening of the throwing wheel of about twenty inches of water or more during rotation of the wheel.

3. The blast media transport and throwing wheel of claim 2 wherein the passageway in the feed cage makes about a 45° angle between the connection to the media conduit means and the axial opening inthe throwing wheel.

4. The blast media transport and throwing wheel of claim 2 wherein the shroud is in the form of a volute with the distance between the shroud and the outer edges of the vanes increasing around the circumference of the throwing wheel in the direction of rotation thereof.

5. A blast media transport and throwing wheel apparatus for propelling blast media against molded articles to remove residual flash therefrom which comprises:

a throwing wheel arranged to be driven around a horizontal axis and including a circular running head, an annular end plate and a plurality of radially extending vanes sandwiched between the running head and annular plate, the opening in the annular plate and the inner edges of the vanes forming a conically shaped axial opening for receiving the media to be propelled;

a shroud member surrounding the throwing wheel, the shroud member having an exit opening through which the media is directed against the articles and an entrance opening aligned with the opening in the annular plate of the throwing wheel;

a feed cage mounted on the shroud and extending through the entrance opening therein and into the axial opening in the throwing wheel, the feed cage having passageway therethrough which terminates above the rotational axis of the throwing wheel adjacent the inner edges of the vanes;

a rotating seal disposed between the annular plate and one of the feed cage and shroud members for substantially preventing ambient air or gas from entering the axial opening in the throwing wheel;

a hopper positioned above the rotational axis of the throwing wheel for holding a static quantity of the media; and a feed tube connecting the hopper and the feed tube to direct media from the hopper into the passageway in the feed cage, the feed tube and hopper being arranged to substantially prevent air or gas from entering the axial opening through the passageway in the feed cage and provide a pressure differential across the inlet and outlet of the throwing wheel of at least twenty inches of water.

* * * * *